US010393001B2

(12) United States Patent
Thorn et al.

(10) Patent No.: US 10,393,001 B2
(45) Date of Patent: Aug. 27, 2019

(54) MARINE EXHAUST SYSTEM

(71) Applicant: Kohler Co., Kohler, WI (US)

(72) Inventors: Christopher D. Thorn, Belgium, WI (US); Tyler J. Sierakowski, Sheboygan, WI (US); Brian M. H. Sheridan, West Bend, WI (US); Sean A. Rusch, Cedarburg, WI (US); Pritam Ramchandra Kudawe, Maharashtra (IN)

(73) Assignee: Kohler Co., Kohler, WI (US)

( * ) Notice: Subject to any disclaimer, the term of this patent is extended or adjusted under 35 U.S.C. 154(b) by 90 days.

(21) Appl. No.: 15/674,348

(22) Filed: Aug. 10, 2017

(65) Prior Publication Data

US 2019/0048778 A1 Feb. 14, 2019

(51) Int. Cl.

| | |
|---|---|
| ***F01N 1/08*** | (2006.01) |
| ***F01N 13/00*** | (2010.01) |
| ***F01N 13/10*** | (2010.01) |
| ***B63H 21/32*** | (2006.01) |

(52) U.S. Cl.

CPC ..... *F01N 13/004* (2013.01); *B63H 21/32* (2013.01); *F01N 1/083* (2013.01); *F01N 13/008* (2013.01); *F01N 13/107* (2013.01); *F01N 2560/025* (2013.01)

(58) Field of Classification Search

CPC ..... F01N 1/083; F01N 13/004; F01N 13/008; F01N 13/107; F01N 2560/025

See application file for complete search history.

(56) References Cited

U.S. PATENT DOCUMENTS

| | | | | |
|---|---|---|---|---|
| 2,717,049 | A * | 9/1955 | Langford | F01N 1/14 165/109.1 |
| 3,219,102 | A | 11/1965 | Taylor | |
| 3,419,107 | A * | 12/1968 | Jozepaitis | F04B 39/0055 181/240 |
| 4,833,882 | A * | 5/1989 | Yasuda | F01N 13/008 60/276 |
| 4,926,634 | A | 5/1990 | Putz et al. | |
| 6,241,044 | B1 * | 6/2001 | Nishiyama | F01N 1/083 181/227 |
| 7,416,052 | B2 * | 8/2008 | Mabuchi | F01N 1/084 181/227 |

(Continued)

FOREIGN PATENT DOCUMENTS

| | | | |
|---|---|---|---|
| CN | 100540859 | C | 9/2009 |
| EP | 0796391 | B1 | 2/1999 |

(Continued)

OTHER PUBLICATIONS

Bullfire "Exhaust System" Publication date Nov. 28, 2015, pp. 1-8, http://bullfire.net/TR6/TR6-53/TR6-53.html.

(Continued)

*Primary Examiner* — Audrey K Bradley

(74) *Attorney, Agent, or Firm* — Lempia Summerfield Katz LLC

(57) ABSTRACT

An exhaust system provides an oxygen sensor within a balance tube for use with a marine engine. The balance tube is configured to protect the oxygen sensor from water that infiltrates the exhaust system. The exhaust system further provides a mounting system configured to attach to an engine such that an axial load placed on the exhaust system.

16 Claims, 10 Drawing Sheets

(56) References Cited

U.S. PATENT DOCUMENTS

| | | | | |
|---|---|---|---|---|
| 7,610,748 | B2 * | 11/2009 | Kono | B62J 99/00 60/274 |
| 7,803,026 | B2 | 9/2010 | McKinney | |
| 8,733,088 | B2 | 5/2014 | Reinhart et al. | |
| 2002/0052157 | A1 | 5/2002 | Kato | |
| 2003/0024299 | A1 | 2/2003 | Fujita et al. | |
| 2005/0023078 | A1 * | 2/2005 | Brower | F01N 1/02 181/272 |
| 2008/0110693 | A1 | 5/2008 | Muto | |
| 2014/0151149 | A1 | 6/2014 | Ross et al. | |
| 2016/0076431 | A1 | 3/2016 | Kuramashi et al. | |
| 2018/0051618 | A1 * | 2/2018 | Tylutki | F01N 13/14 |

FOREIGN PATENT DOCUMENTS

| | | | | |
|---|---|---|---|---|
| EP | 2436895 | A1 * | 4/2012 | F01N 13/008 |
| GB | 1424229 | A | 2/1976 | |
| JP | 2005069208 | A * | 3/2005 | |

OTHER PUBLICATIONS

Thunderheader "Exhaust Systems and Heat Shield Sets", http://thunderheadernet/1071.htm, Date Accessed Apr. 3, 2017.

* cited by examiner

MARINE EXHAUST SYSTEM

TECHNICAL FIELD

This disclosure relates in general to a marine exhaust system, or more particularly, an exhaust system utilizing a balance tube containing an oxygen sensor between two exhaust manifolds that extend into a muffler.

BACKGROUND

Exhaust systems are used with a variety of internal combustion ("IC") engines to direct exhaust from IC engines, filter exhaust gasses, and decrease the amount of noise emitted by the IC engine. Exhaust systems are utilized in a variety of applications such as tractors, automobiles, motorcycles, and marine applications. An exhaust system may include elements that are used to achieve maximum performance of the attached IC engine while decreasing the amount of noise emitted. This may include one or more of a muffler, manifold, oxygen sensor, and/or balance tube. Exhaust systems, however, do not include oxygen sensors within balance tubes, manifold extensions within the muffler cavity, and mounting brackets that support an axial load.

BRIEF DESCRIPTION OF THE DRAWINGS

Exemplary embodiments are described herein with reference to the following drawings.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1:
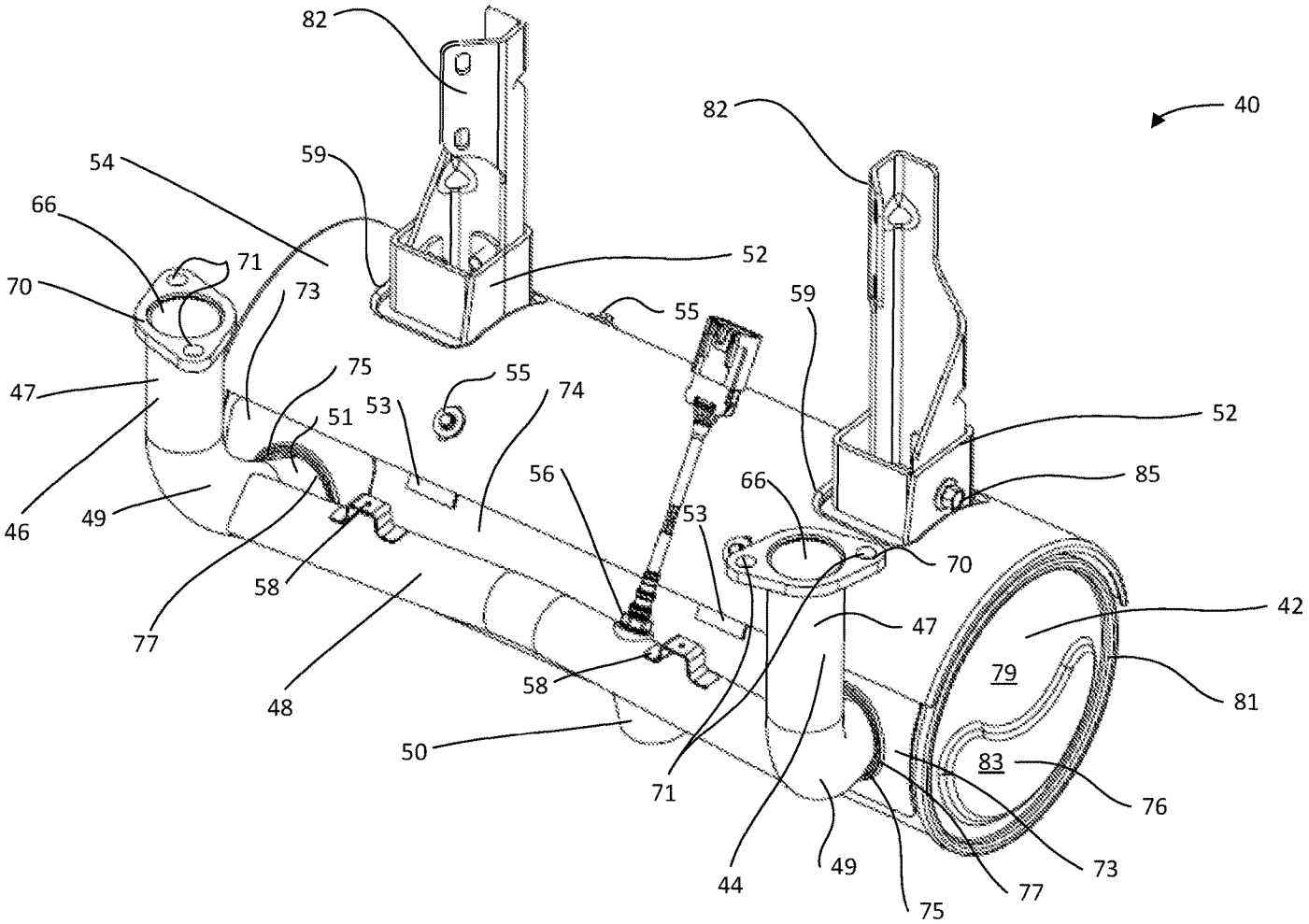
FIG. 1 illustrates an example exhaust system.

FIG. 1 illustrates a perspective view from the rear of an exhaust system 40. The exhaust system 40 generally includes a muffler 42, a first manifold 44, a second manifold 46, a balance tube 48, and an exhaust pipe 50.

The muffler 42, as depicted in FIG. 1 includes a cylinder portion 74 with an end portion 76 on each end of the cylinder portion 74. The cylinder portion 74 is configured in the shape of an elongated cylinder. The cylinder portion 74 includes a hollow interior defining an internal volume. The internal volume includes internal elements of the muffler 42 and exhaust system 40. The internal elements will be further described below.

The cylinder portion 74 of the muffler include two openings 75. The openings 75 are configured for each of the first and second manifolds 44, 46 to extend there through. The diameter of the opening 75 in the muffler 42 is larger than the diameter of the first and second manifolds 44, 46 to provide for sufficient clearance for the first and second manifolds 44, 46 to extend into the muffler 42.

Encompassed around the opening 75 is a collar 73. The collar 73 is rectangularly shaped. The collar 73 includes a collar opening 77. The collar opening is configured such that the lower portion 51 of one of the manifolds 44, 46 extends through. As such, the size of the collar opening 77 is larger than the first and second manifolds 44, 46. The collar 73 is configured to add rigidity to the opening 75 of the muffler 42.

The end portions 76 enclose the cylinder portion 74 on each end. The end portions 76 are shaped as circular discs 79 with a ridge 81 around the circumference of the disc. The ridge 81 of the end portion 76 is formed to engage the edge of the cylinder portion 74. The ridge 81 around the circumference of each of the end portions 76 forms a channel 87 in the end portions 76. Each end of the cylinder portion 74 fits into the channel 87 of a respective end portion 76. The ridge 81 may be rolled to pinch walls of the channel 87 against the ends of the cylinder portion 74.

The end portions 76 also include a raised portion 83 on the disc 79. The raised portion 83 is formed as multiple stepped portions. The raised portion 83 is generally bean-shaped or shaped as an ellipse with a curved major axis. The size of the stepped portions, being slightly smaller than the step below. The raised portion 83 is formed to add structural rigidity to the end portion 76. The configuration of the raised portion 83 operates to increase the stiffness in the muffler to shift the resonant frequencies higher, and away from the range of frequencies of the critical engine orders during operating speeds.

Figure 2:
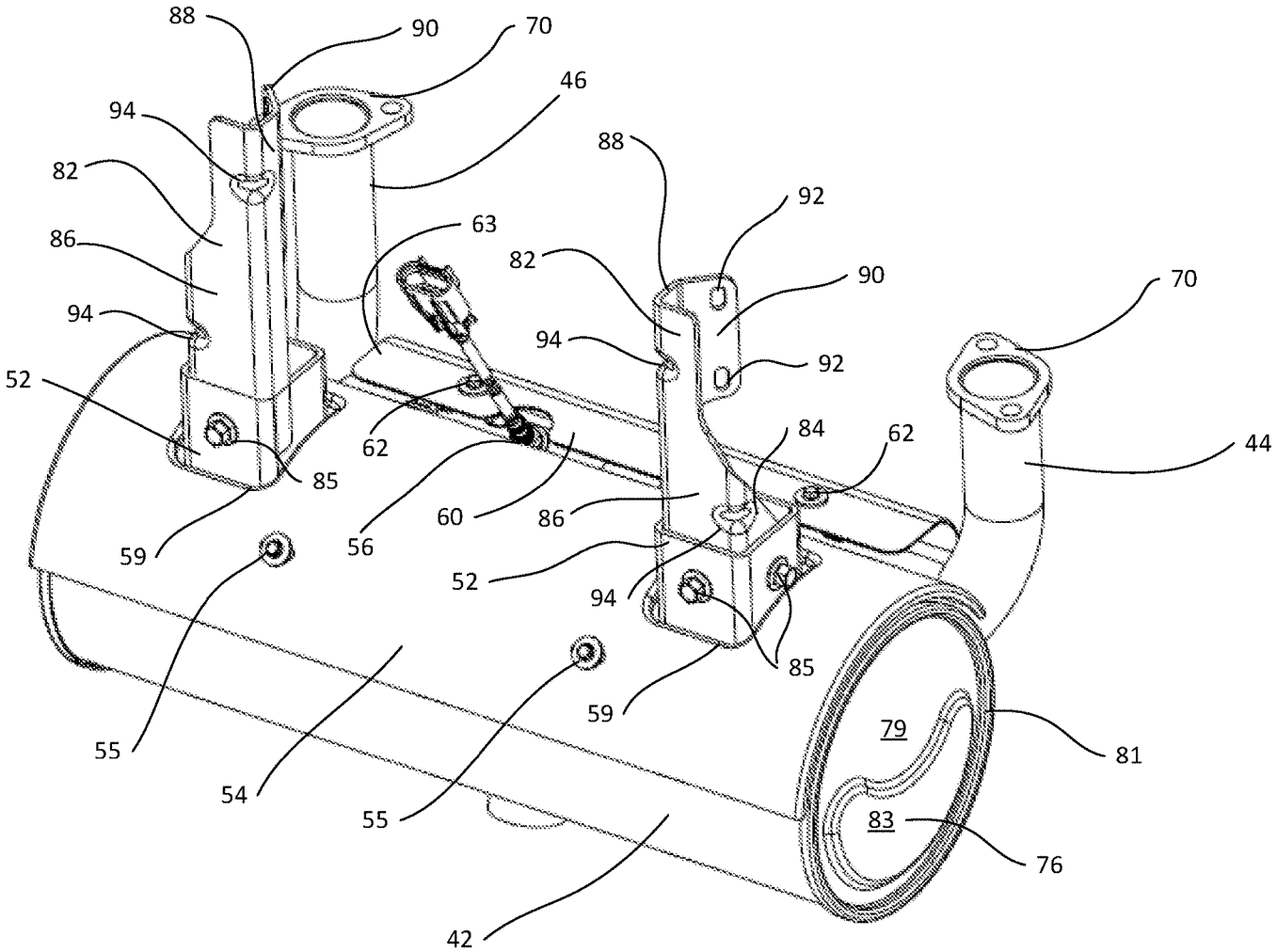
FIG. 2 illustrates an alternative perspective view of the exhaust system of FIG. 1.

As depicted in FIGS. 1 and 2, the muffler 42 further includes two mounting hubs 52. Two mounting hubs 52 are disposed on the cylinder portion 74 of the muffler 42. The mounting hubs 52 act as a connection point for mounting the muffler 42 to an internal combustion engine. The mounting hubs 52 are shaped as an extruded rectangle. The four sides of the mounting hub 52 extend vertically up from the cylinder portion 74 of the muffler 42. Each of the mounting hubs 52 may be formed from a single piece of flat material. The flat material may be bent at substantially 90-degree angles at three locations to create an extruded rectangle configuration. The mounting hubs 52 are connected to the cylinder portion 74 via a weld at the base of the mounting hubs 52. The mounting hubs 52 may also be attached to the cylinder portion 74 by a fastener such as a bolt or screw.

The mounting hubs 52 include at least two openings through which a fastening device such as bolts 85 are placed to attach a bracket 82. The bracket 82 connects the muffler 42 to an internal combustion engine. The bracket 82 includes a first portion 84, second portion 86, third portion 88, and fourth portion 90. The brackets 82 may be formed from a piece of material that is bent to form the first portion 84, second portion 86, third portion 88, and fourth portion 90.

The first portion 84 is in the shape of a right-angled trapezoid. The second portion 86 extends from the first portion 84 at approximately a right angle or substantially thereto. The second portion 86 is in the shape of a right-angle trapezoid and also includes an elongated portion that extends above the first portion 84. A reinforcement indention 94 may be included at the connection of the first portion 84 and second portion 86. The reinforcement indention 94 stiffens the exhaust system 40 to increase the frequencies away from the range of frequencies of the engine during operating speeds The third portion 88 extends from the second portion 86 at a right-angle or substantially thereto. The third portion 88 is shaped as an elongated rectangle. The third portion 88 is substantially same length as the second portion 86. A reinforcement indention 94 may be included at the connection of the second portion 86 and third portion 88. The reinforcement indention 94 adds rigidity and strengthens the bracket 82.

The forth portion 90 extends from the third portion 88. The fourth portion 90 is shaped generally as a rectangle. The fourth portion 90 includes at least two mounting holes 92. The mounting holes 92 are configured to accept a fastening device such as a bolt 168 to secure the bracket 82 and attached muffler 42 to an internal combustion engine. The connection of the exhaust system 40 to an internal combustion engine is described further below.

As depicted in FIG. 1, located on the upper side of the cylinder portion 74 of the muffler 42 are spacers 53. The spacers 53 are attached to the cylinder portion 74 of the muffler 42. The spacers 53 may be attached using fasteners, press fit, or welded to the cylinder portion 74. The spacers 53 provide a fastening point for a muffler heat shield 54. The spacers 53 create a space between the cylinder portion 74 of the muffler 42 and the muffler heat shield 54.

The muffler heat shield 54 is shaped to correspond to the radius or shape of the cylinder portion 74 of the muffler 42. The muffler heat shield 54 extends the length of the cylinder portion 74. Further, the muffler heat shield 54 extends from a front side of the muffler 42 above the opening 75, over the top of the muffler 42 to a back side of the muffler 42.

As depicted in FIGS. 1 and 2, the muffler heat shield 54 includes cut-outs 59 within the muffler heat shield 54. The cut-outs 59 are through openings in the muffler heat shield 54. The cut-outs provide an opening for the mounting hubs 52 to extend therethrough. The cut-outs 59 are located within the muffler heat shield 54 so as to align and fit over the mounting hubs 52. The cut-outs 59 are substantially the same size and shape of the mounting hubs 52, just slightly larger so that the muffler heat shield 54 may fit over the mounting hubs 52 and mount contact the spacers 53.

The muffler heat shield 54 is attached to the muffler 42 by bolts 55. The bolts 55 extend through the muffler heat shield 54 and into the spacers 53. The bolts 55 secure the heat shield 54 to the spacers 53.

Further depicted in FIG. 1, are the first manifold 44 and second manifold 46. The first manifold 44 and second manifold 46 each includes an upper portion 47 configured to mount to an internal combustion engine. The upper portion 47 includes an inlet 66. Exhaust gas is configured to enter the upper portion 47 at the inlet 66. As depicted in FIG. 1, the upper portion 47 is configured to be in a vertical orientation.

The upper portion 47 includes a flange 70 containing two through holes 71 to accept a bolt or other fastener. A fastener may be placed through the holes 71 in order to attach the first manifold 44 and second manifold 46 to an internal combustion engine. The flange 70 may be press fit to the upper portion 47 of each of the first and second manifolds 44, 46 or attached by any suitable fastener. Likewise, the flange 70 may be formed from the upper portion 47 of the first and second manifolds 44, 46.

Downstream from the upper portion 47 of each of the first and second manifolds 44, 46 is a first bend 49. The first bend 49 is an angled portion in each of the first manifold 44 and second manifold 46. The first bend 49 has an angle in the range of 85 degrees to 110 degrees from the upper portion 47. The first bend 49 directs the first manifold 44 and second manifold 46 from a generally vertical orientation of the upper portion 47 to a downward angled orientation at the outlet of the first bend 49.

A lower portion 51 of the first and second manifolds 44, 46 extends from the first bend 49. As depicted in FIG. 1, the lower portions 51 of the first and second manifolds 44, 46 extend into the muffler 42. The lower portions 51 of the first and second manifolds 44, 46 will be discussed further below.

As depicted in FIG. 1, the first manifold 44 and the second manifold 46 include the balance tube 48 extending therebetween. The balance tube 48 creates a fluid passage between the first manifold 44 and the second manifold 46. The balance tube 48 may be located anywhere along the upper portion 47, first bend 49, or lower portion 51 of the first and second manifolds 44, 46. It is further contemplated that the balance tube 48 may be located anywhere along the first manifold 44 and second manifold 46 as further described below. The balance tube 48 may be the same diameter as the first and second manifolds 44, 46 or may be larger or smaller in diameter.

The balance tube 48 includes an oxygen sensor 56 located along the length of the balance tube 48. The oxygen sensor 56, as depicted in FIG. 1, is located closer to the first manifold 44. The oxygen sensor 56 may, however, be located nearer the second manifold 46, or anywhere along the length of the balance tube 48. The sensing element of the oxygen sensor 56 is inserted into the interior of the balance tube 48 through an opening in the balance tube 48 and attached to the interior of the balance tube 48. In one example, the oxygen sensor 56 is inside the balance tube 48 and communicates with another component on the outside of the balance tube 48. The communication may include wireless radio waves or magnetic waves. The oxygen sensor 56 may attach to the balance tube 48 via threads or any other suitable manner to secure the oxygen sensor 56 to the balance tube 48 in an air-tight fashion.

The oxygen sensor 56 is configured to measure the proportion of the oxygen gas ($O_2$) within exhaust gas in the balance tube 48 from an internal combustion engine to which the exhaust system 40 is attached. The oxygen sensor 56 may be configured to operate with an electronic fuel injection system of an attached internal combustion engine. The oxygen sensor 56 includes wiring harness that includes a connector. The connector allows for easy connect and disconnect with an associated electronic fuel injection system.

As depicted in FIG. 1, the balance tube 48 also includes two brackets 58. The brackets are generally disposed on the top of the balance tube 48. The brackets 58 are generally U-shaped brackets with attachment portions that are connected to the balance tube 48. At the upper most portion of the bracket, a hole is formed within for accepting a fastener. The brackets 58 are configured to support a balance tube heat shield 60 above the balance tube 48.

As depicted in FIG. 2, the balance tube heat shield 60 is disposed over the balance tube 48. The balance tube heat shield 60 extends substantially from the first manifold 44 to the second manifold 46. The balance tube heat shield 60 is formed from a flat and thin piece of material. The balance tube heat shield 60 is configured to protect the balance tube 48 and oxygen sensor 56 from heat radiating from an internal combustion engine in operation. The balance tube heat shield 60 is configured to prevent heat radiating from an attached internal combustion engine from damaging the electrical components of the oxygen sensor 56 or attached wiring.

Figure 3:
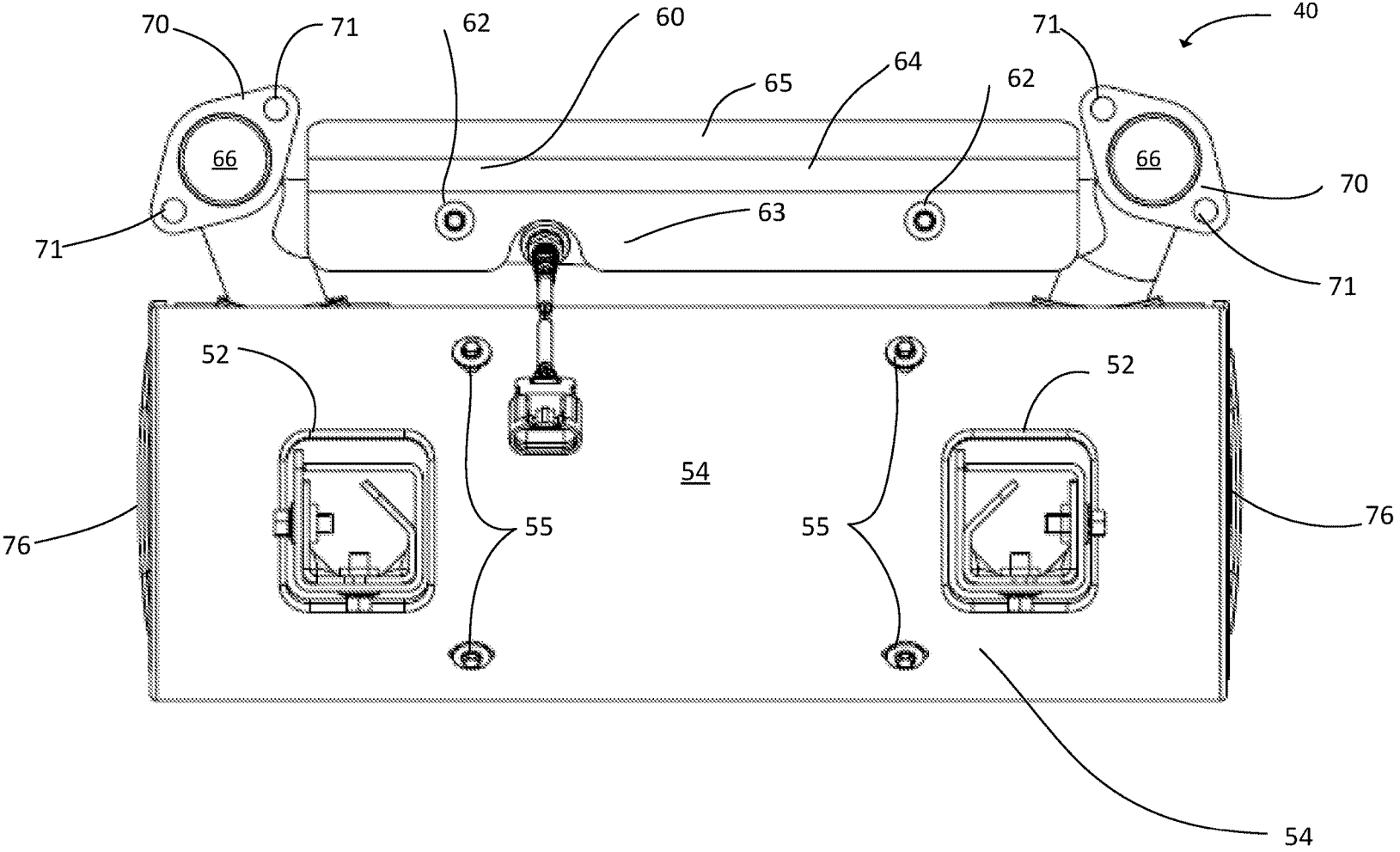
FIG. 3 illustrates a detailed top view of the exhaust system as depicted in FIG. 1.

As depicted in FIGS. 2 and 3 the balance tube heat shield 60 is formed to include a first portion 63, a second portion 64, and third portion 65. The first portion 63 of the balance tube heat shield 60 is disposed above the balance tube 48. The balance tube heat shield 60 is attached to the balance tube 48 via bolts 62 attaching the first portion 63 to the brackets 58.

The second portion 64 extends from the first portion 63. The second portion 64 includes a bend or radiused portion. The second portion 64 generally bends or directs the balance tube heat shield 60 around the balance tube 48. The second portion 64 may bend the balance tube heat shield 60 in an angle range. Example angle ranges include 95 degrees to 140 degrees 110 degrees to 120 degrees from the first portion 63.

The third portion 65 extends from the second portion 64. The third portion 65 may extend at the same or similar angle of the second portion 64. The third portion 65 extends down from the second portion 64 to further shield the balance tube 48.

The first manifold 44, second manifold 46, and balance tube 48, as described above, are depicted as cylindrical tubes. The first manifold 44, second manifold 46, and balance tube 48, however, may be of any shape suitable to allow the exhaust gasses to flow within the exhaust system 40. The first manifold 44, second manifold 46, and balance tube 48 may be each constructed from a uniform tube, or a segmented tube fastened together. The first manifold 44, second manifold 46, and balance tube 48 may be constructed of cast iron, stainless steel, aluminum or any metal or material suitable to convey the exhaust gasses within the exhaust system 40.

Figure 4:
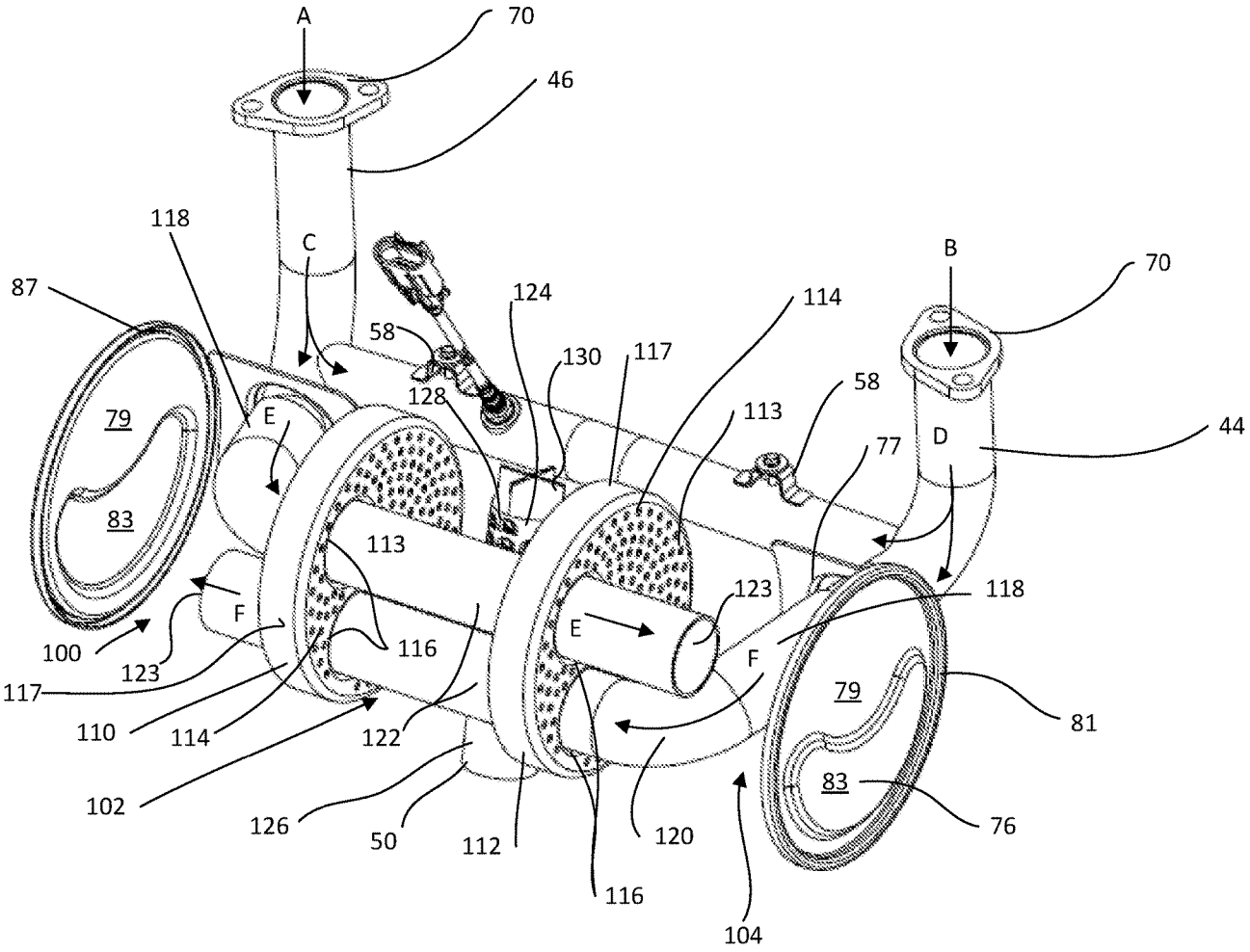
FIG. 4 illustrates an internal front perspective view of the exhaust system of FIG. 1.

FIG. 4 depicts the internal elements referenced above found within the internal volume of the muffler 42. Located within the internal volume are the first manifold 44, second manifold 46, exhaust pipe 50, first baffle 110, and second baffle 112. The first baffle 110 and second baffle 112 divide the internal volume into three chambers: a first chamber 100, a second chamber 102, and a third chamber 104.

The first and second baffles 110, 112 include a planar section 113. The planar section 113 of the first and second baffles 110, 112 includes multiple openings 114 disposed over the surface. The openings 114 are configured to allow exhaust gas to flow through the first and second baffles 110, 112 and between the chambers 100, 102, and 104.

The first and second baffles 110, 112 further each include two passages 116. Passages 116 are through holes located on the planar section 113 of the first and second baffles 110, 112. Passages 116 are sized to accommodate one of the first manifold 44 or second manifold 46 through the passage 116. The passages 116 are shown as being orientated vertically, with one above the other. The passages 116, however, may be orientated anywhere on the planar section 113 such that each of the first manifold 44 and second manifold 46 may pass through both the first baffle 110 and second baffle 112.

The first and second baffles 110, 112 also include a rim 117 located at the edge or perimeter of the first and second baffles 11, 112. The rim 117 extends perpendicular to the planar section 113 of the first and second baffles 110, 112. The rim 117 may extend around or substantially around the entire perimeter of the planar section 113. The rim 117 interacts with and provides structural support to the cylinder portion 74 of the muffler 42.

As referenced above, the first manifold 44 and second manifold 46 extend into the interior volume of the muffler 42. The lower portion 51 of first manifold 44 extends through the muffler opening 75 and into the first chamber 100. A transverse portion 118 extends from the lower portion 51 of the first manifold 44. The transverse portion 118 of the first manifold 44 extends within the first chamber 100, traversing a portion thereof.

A second bend 120 of the first manifold 44 extends from the transverse portion 118. The second bend 120 has an angle in the range of 90 degrees to 120 degrees from the transverse portion 118. The second bend 120 directs the first manifold 44 from a traverse direction within the muffler 42 to a longitudinal direction within the muffler 42.

An extension portion 122 of the first manifold 44 extends from the second bend 120. The extension portion 122 runs longitudinal with the internal volume of the muffler 42. The extension portion 122 runs from the first chamber 100 and extends through the first baffle 110 across the second chamber 102, through the second baffle 112 and into the third chamber 104 where it ends.

Similarly, the lower portion 51 of second manifold 46 extends through the muffler opening 75 and into the third chamber 104. A transverse portion 118 extends from the lower portion 51 of the second manifold 46. The transverse portion 118 extends within the third chamber 104, traversing a portion thereof.

A second bend 120 of the second manifold 46 extends from the transverse portion 118. The second bend 120 has an angle in the range of 95 degrees to 120 degrees from the transverse portion 118. The second bend 120 directs the second manifold 46 from a traverse direction within the muffler 42 to a longitudinal direction within the muffler 42.

An extension portion 122 of the second manifold 46 extends from the second bend 120. The extension portion 122 runs longitudinal with the internal volume of the muffler 42. The extension portion 122 of the second manifold 46 runs from the third chamber 104 and extends through the second baffle 112 across the second chamber 102, through the first baffle 110 and into the first chamber 100 where it ends.

The extension portions 122 of the first and second manifolds 44, 46 extend the overall length of the manifolds. The added length of the first and second manifolds 44, 46 increase horsepower of an internal combustion engine connected with the exhaust system 40. Further, locating the extension portion 122 within the internal volume of the muffler 42

As depicted in FIG. 4, the exhaust pipe 50 is located in the second chamber 102. The exhaust pipe 50 is a hollow tube. The exhaust pipe 50 includes an upper end 124 and a lower end 126. The upper end 124 includes multiple holes 128. The holes 128 are through openings in the upper end 124 that allow for exhaust to flow into the upper end 124 of the exhaust pipe 50 to exit the muffler 42. Located at the upper most portion of the upper end 124 is an end cap 130. The end cap 130 as depicted in FIG. 4 is formed by compressing the upper end 124 of the exhaust pipe 50 and thereby compressing the hollow tube portion of the exhaust pipe 50.

The lower end 126 of the exhaust pipe 50 extends from the upper portion 124 down through the second chamber 102 through an opening 132 in the cylinder portion 74 to outside the muffler 42. Exhaust gas exits the lower portion 124 and leaves the exhaust system 40.

Figure 5:
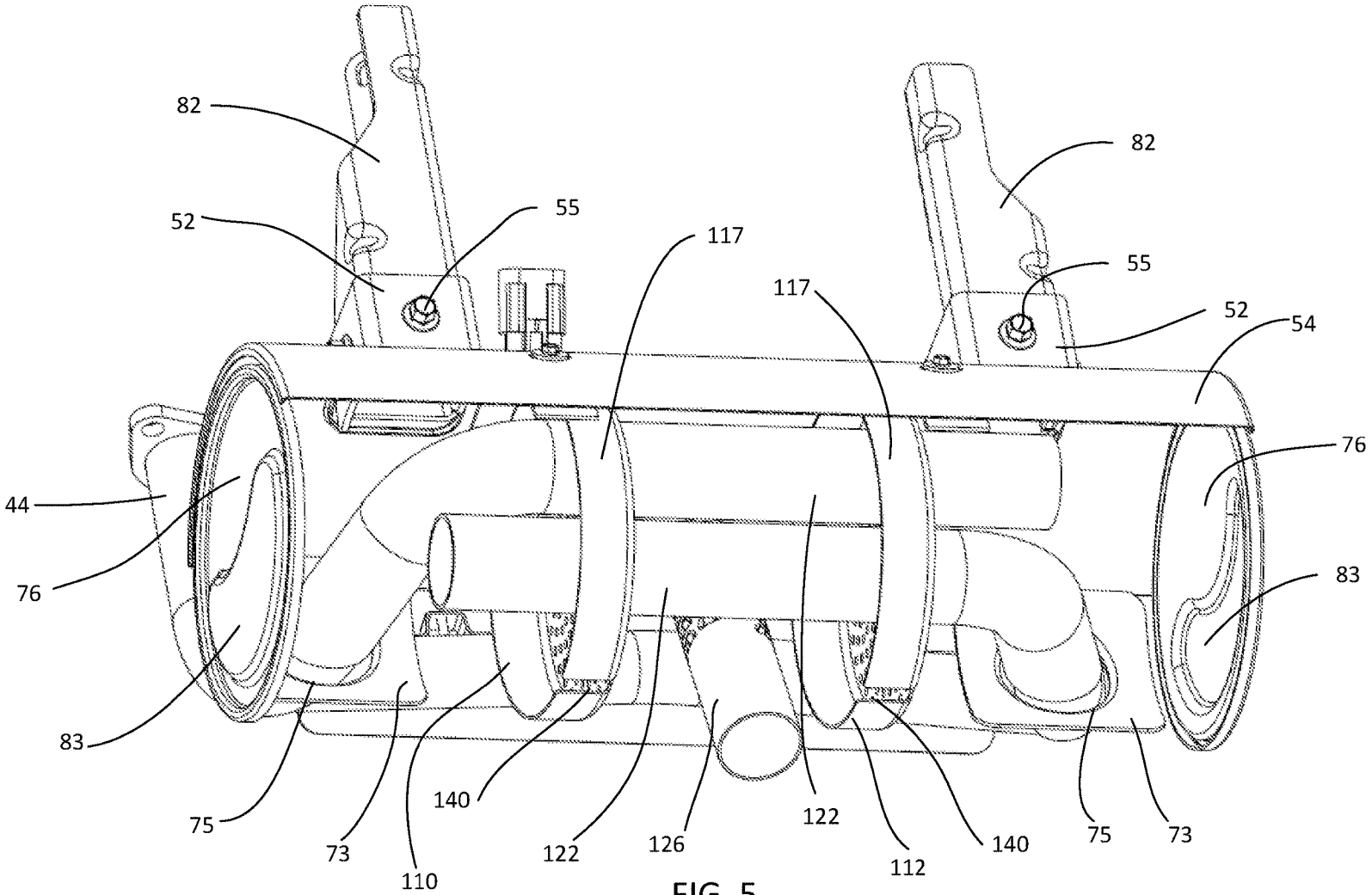
FIG. 5 illustrates a bottom internal perspective view of the exhaust system of FIG. 1.

As depicted in FIG. 5, the first baffle 110 and second baffle 112 include a channel 140. The channel 140 is at the lowest most portion of the first and second baffles 110, 112. The channel 140 is formed as a rectangular cut-out in the rim 117. The channel 140 is formed to allow the passage of water or fluids from the first chamber 100 and the third chamber 104 to flow into the second chamber 102.

Figure 6:
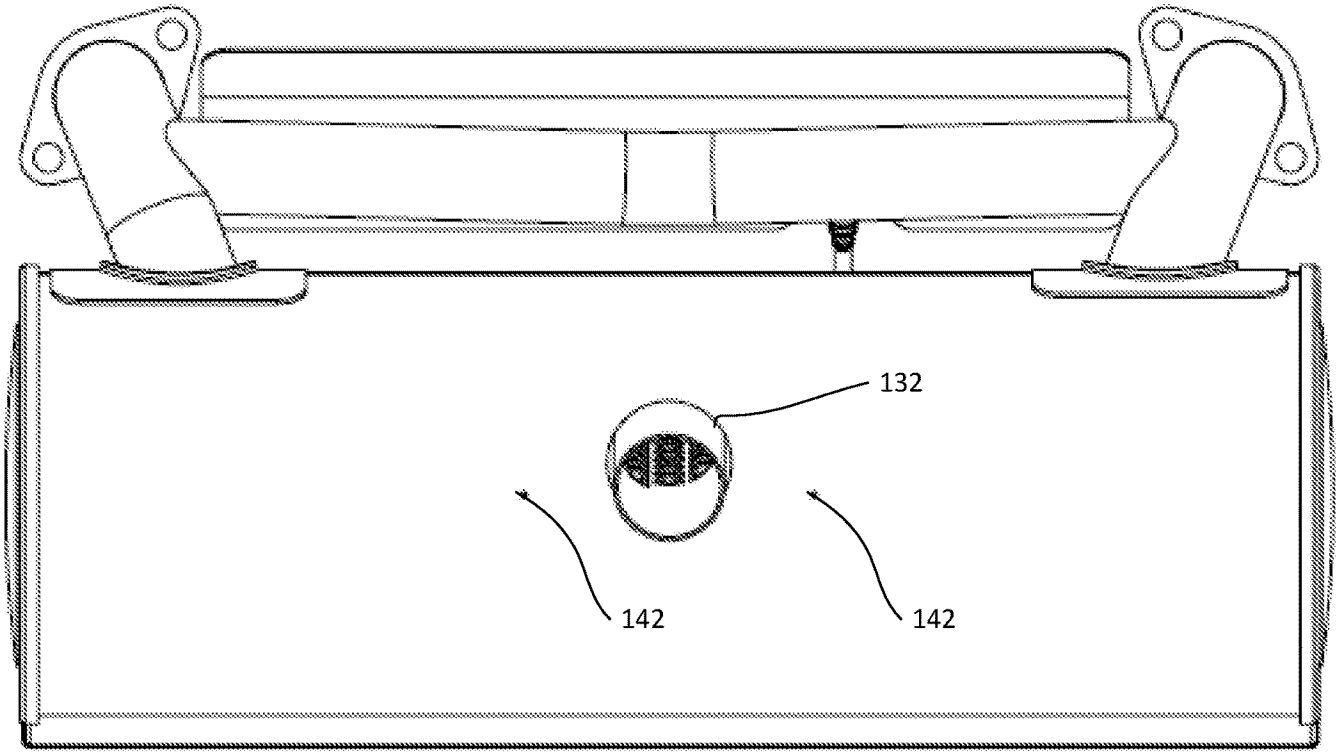
FIG. 6 illustrates a bottom view of the exhaust system of FIG. 1.

As depicted in FIG. 6, the bottom of the muffler 42 includes drain holes 142. The drain holes 142 are configured to allow water or fluids within the second chamber 102 to drain from the internal volume of the muffler 42. This allows any water or fluids that enter the muffler 42 to exit the muffler 42. Draining water or fluids from the muffler 42 ensures peak performance and prevents components of the muffler 42 from rusting.

Figure 7:
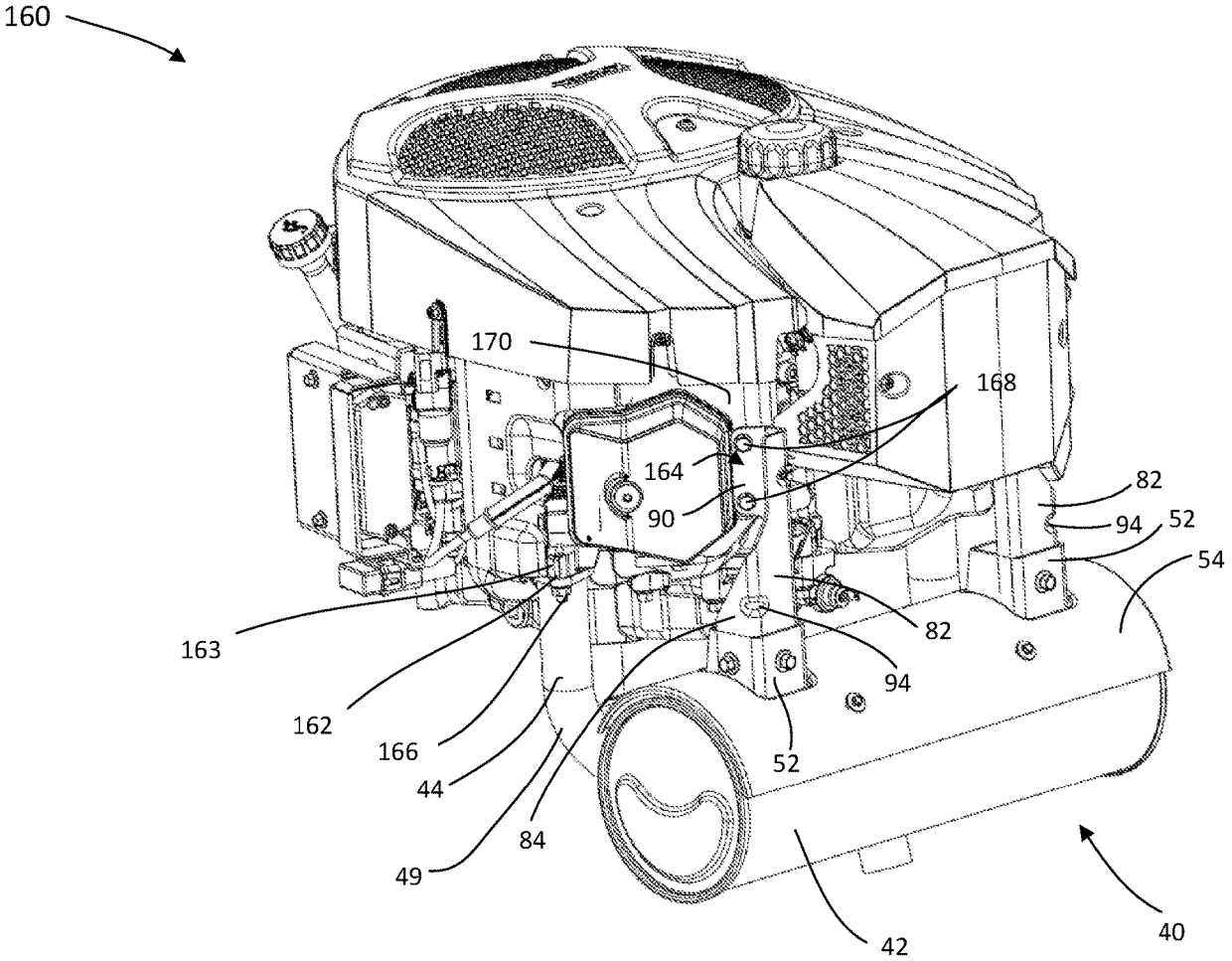
FIG. 7 illustrates the exhaust system of FIG. 1 in connection with an internal combustion engine.
Figure 8:
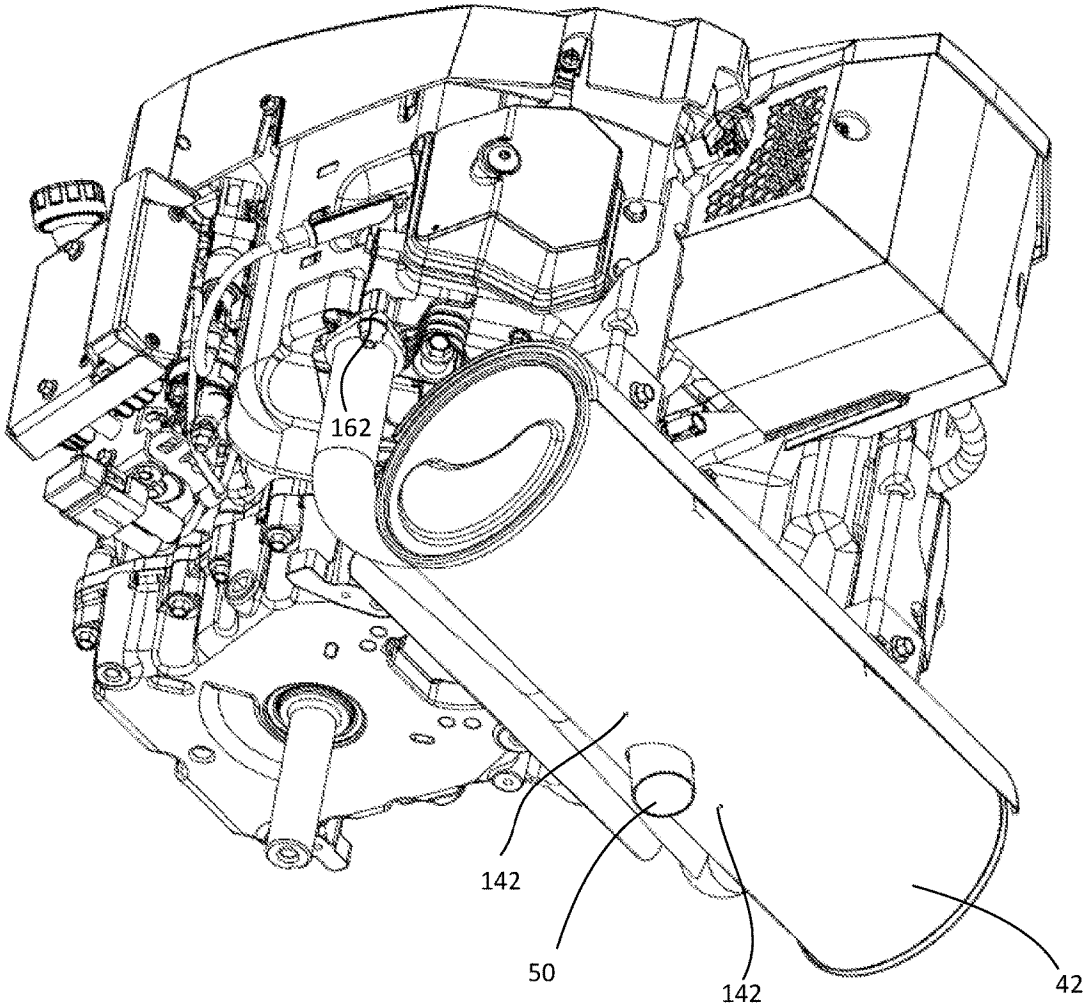
FIG. 8 illustrates a bottom view of the combination of the internal combustion engine and exhaust system of FIG. 8.

As depicted in FIGS. 7 and 8, the exhaust system 40 may be configured to be connected with an internal combustion engine 160. The engine 160 may include external components such as crankshaft, fuel tank, flywheel, air cleaning system, and an electronic fuel injection module. The engine 160 may be a two-stroke engine or a four-stroke engine. The number of cylinders of the engine 160 may vary to include two cylinders or more than two cylinders. The size of the engine 160 may vary depending on the application.

The engine 160 may be any type of engine in which the combustion of a fuel (e.g., gasoline or another liquid fuel) with an oxidizer (e.g., air) in a chamber applies a force to a drive component (e.g., piston, turbine, or another component) of the engine 160. The drive component rotates to turn a drive shaft.

As depicted in FIG. 7, the exhaust system 40 is connected to the engine 160. The first and second manifolds 44, 46 each attach to the engine 160 at a manifold connection 162. Bolts 166 are inserted through the holes 71 of flange 70 of the first and second manifolds 44, 46. The bolts 166 are attached to an exhaust port or exhaust manifold 163 of the engine 160. The manifold connection 162 is configured to create a substantially air-tight connection between the engine 160 and the first and second manifolds 44, 46. A gasket may be placed between the flange 70 and the exhaust port or exhaust manifold of the engine 160 to create the air-tight seal.

The exhaust system 40 also attaches to the engine 160 via the brackets 82 at a mounting connection 164. Bolts 168 are inserted through the mounting holes 92 of the fourth portion 90 of the bracket 82. The bolts 168 are then fastened to the engine cylinder head 170. The brackets 82 and mounting hubs 52 attaching the muffler 42 of the exhaust system 40 to the engine 160. The brackets 82 and mounting hubs 52 function to create an axial load relationship between the engine 160 and exhaust system 40. This arrangement removes the frequency from the critical running engine operating orders 160 placed upon the exhaust system 40.

The exhaust system 40 functions to improve exhaust gas flow, extend oxygen sensor performance and longevity, reduce engine backpressure, and improve acoustical performance of the muffler 41 without reducing an internal combustion engine's horsepower.

In operation, the exhaust system 40 is connected with an internal combustion engine 160 as depicted in FIGS. 7 and 8. As the engine 160 operates, exhaust gases are created in the cylinder head. Exhaust gases are caused to flow from the cylinder head to the associated first and second manifolds 44, 46.

Depicted in FIG. 4, exhaust A enters the first manifold 44 at the inlet 66 and travels down though the upper portion 47 of the first manifold 44. Exhaust then enters the first bend 49 of the first manifold 44. As the exhaust C flows through the first bend 49, some portion of the exhaust continues to flow through the lower portion 51 of the first manifold 44, while another portion of the exhaust flows into the balance tube 48.

In alternating fashion as the engine 160 cycles, exhaust B also enters the second manifold 46 at the inlet 66 and travels down though the upper portion 47 of the second manifold 46. Exhaust enters the first bend 49 of the second manifold 46. As the exhaust D flows through the first bend 49, some portion of the exhaust continues to flow through the lower portion 51 of the second manifold 46, while another portion of the exhaust flows into the balance tube 48.

Exhaust that flows into the balance tube 48 via the first and second manifolds 44, 46 continuously mixes. The balance tube 48 works to equalize the pressures in the first manifold 44 and second manifold 46. The balance tube 48 allows the exhaust system 40 to handle more volume of exhaust gas flow. As a result, the engine 160 experiences an increase in horsepower, reduced engine backpressure, and improved acoustical performance.

Exhaust that flows into the balance tube 48 is measured by the oxygen sensor 56. The oxygen sensor 56 measures the proportion or ratio of oxygen in the exhaust in the balance tube 48 as compared to the outside air. This measurement of the difference between the amount of oxygen in the exhaust gas and the amount of oxygen in air is measured on a set frequency or the measurement is continuous.

Figure 9:
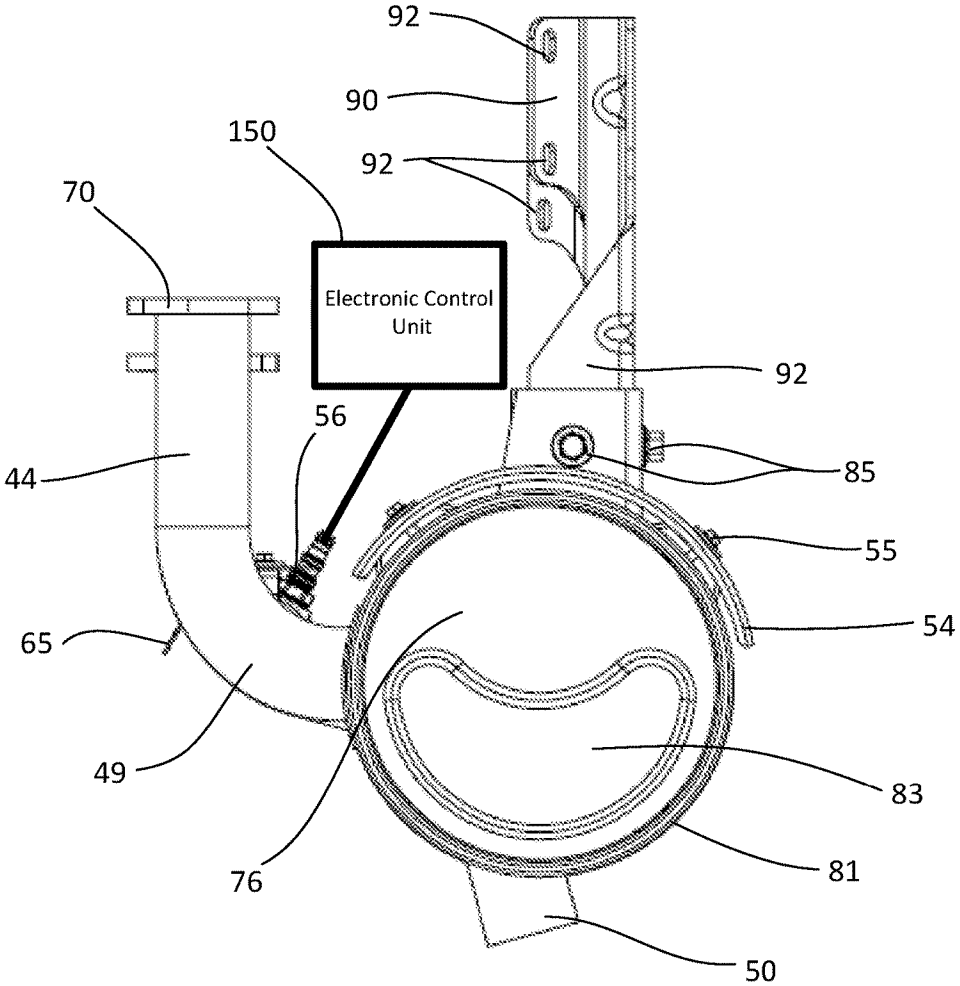
FIG. 9 illustrates side view of the exhaust system of FIG. 1.

As depicted in FIG. 9, the measurements are then sent from the oxygen sensor 56, via an electrical connection and/or communication interface, to an electronic control unit 150 and may be stored in memory by the electronic control unit 150. The measurements may be transferred wirelessly to the electronic control unit 150 or to an external device such as a diagnostic tool. The electronic control unit 150 may analyze the measurement data through filtering, averaging or another statistical analysis, or comparing values in the measurement data to one or more thresholds. For example, the electronic control unit 150 may compare the measurement data to a threshold selected based on one or more muffler or engine parameters. An example of muffler parameters may include the volume of the muffler, the model of the muffler, and the application (e.g., marine) of the muffler. Example engine parameters may include the model of the engine, the manufacturing of the engine, the size of the engine, or other characteristics. The electronic control unit 150 may be configured to adjust the air to fuel ratio within the combustion chambers of the engine 160 based on the comparison in order to optimize engine performance.

Exhaust that flows to the lower portion 51 of the first and second manifolds 44, 46 follows the path of the manifolds. As depicted in FIG. 4, exhaust E flows through the first manifold 44, flowing through the lower portion 51, the transverse portion 118, the second bend 120, and the extension portion 122. The exhaust E then exits the first manifold 44 at an outlet 123 located at the extension portion 122 within the third chamber 104.

Likewise, exhaust F flows through the second manifold 46, flowing through the lower portion 51, the transverse portion 118, the second bend 120, and the extension portion 122. The exhaust F then exits the second manifold 46 at an outlet 123 located at the extension portion 122 within the first chamber 100.

Exhaust within the first chamber 100 flows through the openings 114 in the first baffle 110 and into the second chamber 102. Exhaust within the third chamber 104 flows through the openings 114 in the second baffle 112 and into the second chamber 102.

Exhaust within the second chamber 102 flows through the holes 128 in the upper end 124 of the exhaust pipe 50. Exhaust that enters the exhaust pipe 50 is then forced to the lower end 126 of the exhaust pipe 50 and out of the muffler 42.

As referenced above, one application for the disclosed exhaust system 40 is in connection with a marine engine. It is, however, contemplated that the disclosed exhaust system 40 may be used with internal combustion engines in connection with lawn equipment, tractors, all-terrain vehicles, automobiles, motorcycles, or the like. Marine engines and associated exhaust systems are exposed to water during operation. A specific marine implementation may be as a mud boat exhaust system. Depending on the marine implementation of the exhaust system 40, it is possible that the muffler 42 may be exposed to water. In some instances, the exhaust pipe 50 of the muffler 42 or a portion of the muffler itself may become submerged in water. Submerging the exhaust pipe 50 or muffler 42 in water may cause water to enter the internal volume of the muffler 42 and reside in any of the first, second and/or third chambers 100, 102, 104.

When utilized within a mud boat, it may be necessary to mount the exhaust system in close proximity to the engine. As a result, the balance tube, oxygen sensor and oxygen sensor components will be subjected to high heat. In these instances, the heat shield 54 protects the balance tube, oxygen sensor, and oxygen sensor components from the high engine temperatures. The heat shield 54 also works to prevent hot air resonating from the muffler 42 from entering the intake manifold.

As depicted in FIGS. 5 and 6, the exhaust system 40 is designed to allow water to drain from the muffler 42. Water that has entered the muffler may flow to any of the first, second and/or third chambers 100, 102, 104. Water that resided in the first chamber 100 may drain from the first chamber 100 into the second chamber 102 via the channel 140 in the first baffle 110. Likewise, water that resides in the third chamber 104 may drain into the second chamber 102 via channel 140 in the second baffle 112.

Water residing in the second chamber 102 may drain from the muffler 42 through drain holes 142. Removing the water within the muffler 42 prolongs the life of the exhaust system and preserves the performance of the exhaust system and associated engine.

Additionally, utilizing an exhaust system in a marine environment may affect other exhaust system components, such as the oxygen sensor. Placing the oxygen sensor 56 in the balance tube 48 protects the oxygen sensor 56 from water contacting the oxygen sensor 56. Preventing water from contacting the oxygen sensor 56 improves the failure rate, as water will likely cause an oxygen sensor to fail.

Figure 10:
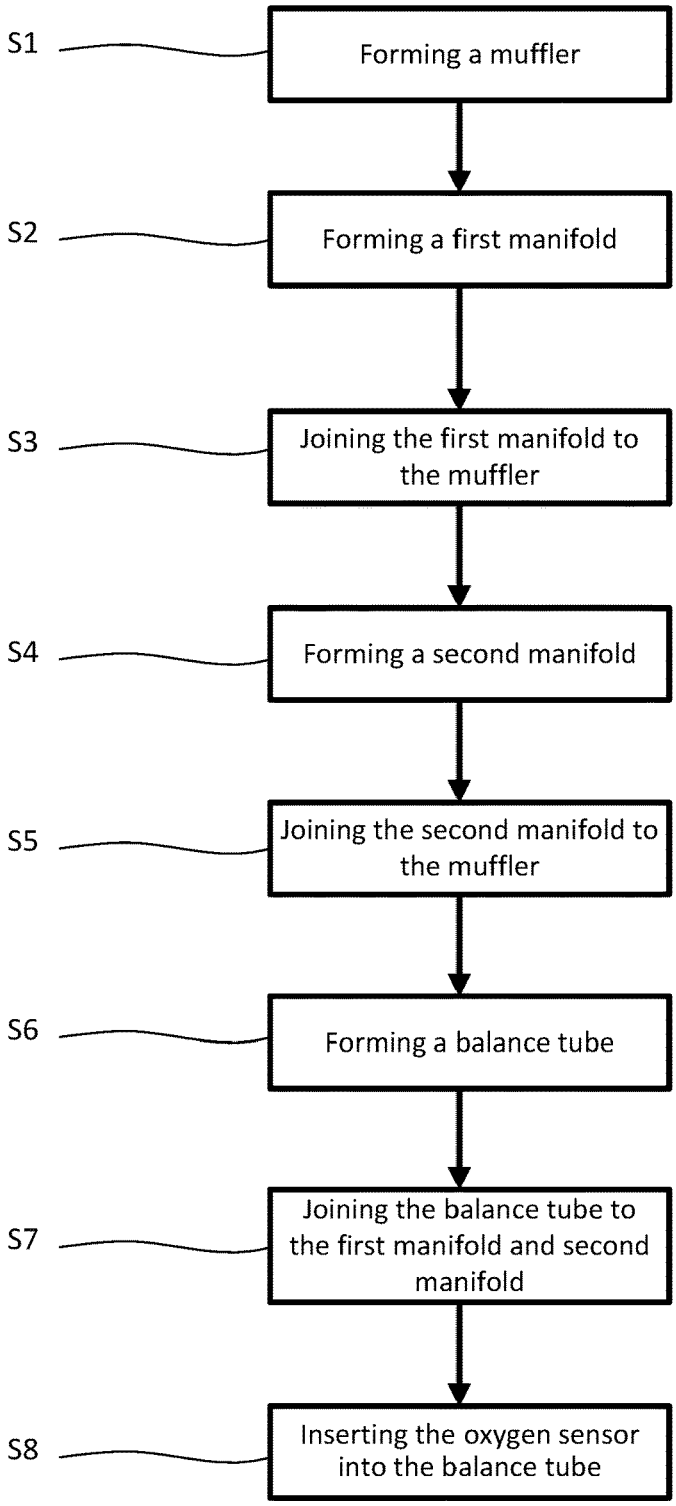
FIG. 10 illustrates a flowchart depicting the method of manufacturing an example exhaust system.

A method of manufacturing the engine muffler according to the present disclosure, as depicted in FIG. 10, comprises the steps of forming the muffler S1; forming the first manifold S2; joining the first manifold to the muffler S3; forming the second manifold S4; joining the second manifold to the muffler S5; forming the balance tube S6; joining the balance tube to the first manifold and the second manifold such that the balance tube is in fluid communication with the first manifold and the second manifold S7; and inserting the oxygen sensor into the balance tube S8.

The first and second manifolds 44, 46 may each be formed from a single piece of tubing. The first and second manifolds 44, 46 tubing is formed into a structure as describe above by bending the tubing to form the desired shape. Alternatively, some portion or each of the upper portion 47, first bend 49, lower portion 51, transverse portion 118, second bend 120, and extension portion 122 of the first and second manifolds 44, 46 may be formed from separate pieces of tubing that are joined together. Each of the separate pieces may be joined by welding, expansion connections, or other joining process. Alternatively, the upper portion 47, first bend 49, lower portion 51, transverse portion 118, second bend 120, and extension portion 122 of the first and second manifolds 44, 46 may be formed from a single piece of pipe using a tube bender.

The muffler 42 may be formed by forming the baffles 110, 112 using a punch press, where a flat sheet of material forms the baffle structure as described above. The end portions 76 may be formed in the same manner as the baffles 110, 112.

The cylinder portion 74 of the muffler 42 may be formed from a piece of flat material. Openings 75 and exhaust opening 132 are formed in the cylinder portion 74. The cylinder portion 74 may be bent into a cylindrical shape and fastened. The baffles 110, 112 may be placed within the cylinder portion 74 and secured, forming the muffler 42. The first and second manifolds 44, 46 are joined with the muffler 42.

The balance tube 48 may be formed from a single piece of tubing. The balance tube 48 is formed into a structure as describe above. The balance tube is joined to the first and second manifolds 44, 46 by welding or other fastening mechanism. The oxygen sensor is inserted into the balance tube 48.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

We claim:

1. An exhaust system comprising:

a muffler including a body with an internal volume, a first baffle and a second baffle located within the internal volume;

a first manifold including a bend located within the internal volume;

a second manifold including a bend located within the internal volume; and a balance tube including an oxygen sensor, the balance tube in fluid communication with the first manifold and the second manifold wherein the first manifold, the second manifold or the first and second manifolds extend through at least one first opening in the first baffle and at least one second opening in the second baffle.

2. The exhaust system of claim 1, wherein the oxygen sensor is configured to measure an exhaust gas concentration of oxygen in the first manifold and the second manifold.

3. The exhaust system of claim 1, wherein the first baffle and the second baffle divide the internal volume into a first chamber, a second chamber, and a third chamber.

4. The exhaust system of claim 3, wherein the first manifold extends into the first chamber of the muffler and extends through the muffler to the third chamber.

5. The exhaust system of claim 3, wherein the second manifold extends into the third chamber of the muffler and extends through the muffler to the first chamber.

6. The exhaust system of claim 1, wherein each of the first baffle and the second baffle includes perforations to allow exhaust gas to flow through the first baffle and the second baffle.

7. The exhaust system of claim 1, wherein the muffler includes mounting brackets that are configured to attach the muffler to a cylinder head of an internal combustion engine such that a muffler load is in an axial direction.

8. The exhaust system of claim 1, further comprising:

a heat shield configured to shield the balance tube from heat generated from an internal combustion engine.

9. The exhaust system of claim 1, wherein the muffler includes at least one drain hole configured for draining water within the muffler.

10. The exhaust system of claim 9, wherein the at least one drain hole is located between the first and second baffles and wherein each of the first and second baffles includes channels configured for draining water across the first and second baffles.

11. An internal combustion engine system comprising:

an internal combustion engine including a first cylinder bank on a first side of the internal combustion engine and a second cylinder bank on a second side of the internal combustion engine;

a muffler including a body with an internal volume, a first baffle and a second baffle located within the internal volume, wherein the first baffle and the second baffle divide the internal volume into a first chamber, a second chamber, and a third chamber;

a first manifold including a bend located within the internal volume;

a second manifold including a bend located within the internal volume;

a balance tube including an oxygen sensor, the balance tube in fluid communication with the first manifold and second manifold; and an exhaust pipe;

wherein the first manifold extends into the first chamber of the muffler and extends through the muffler to the third chamber.

12. The internal combustion engine system of claim 11, wherein the first manifold extends from the first bank through a first side of the muffler and the second manifold extends from the second bank through a second side of the muffler.

13. The internal combustion engine system of claim 11, wherein the muffler further comprises mounting brackets on the top of the muffler that secure the muffler to a cylinder head of the internal combustion engine, supporting the muffler in an axial direction.

14. The internal combustion engine system of claim 11, wherein the oxygen sensor is configured to measure an exhaust gas concentration of oxygen in the first manifold and the second manifold.

15. The internal combustion engine system of claim 11, further comprising a heat shield configured to shield the balance tube from heat generated from the internal combustion engine.

16. A method of manufacturing an exhaust system for an internal combustion engine system, the method comprising:

forming a muffler including a body with an internal volume, a first baffle and a second baffle located within the internal volume;

forming a first manifold with at least one first bend;

joining the first manifold to the muffler, wherein the at least one first bend is located in the internal volume and the first manifold extends through a first opening in the first baffle and a second opening in the second baffle;

forming a second manifold with at least one second bend;

joining the second manifold to the muffler, wherein the at least one second bend is located in the internal volume;

forming a balance tube;

joining the balance tube to the first manifold and the second manifold such that the balance tube is in fluid communication with the first manifold and the second manifold;

inserting an oxygen sensor into the balance tube;

forming an exhaust pipe; and joining the exhaust pipe to the muffler.

* * * * *